US011537064B2

(12) United States Patent
Taniguchi

(10) Patent No.: US 11,537,064 B2
(45) Date of Patent: Dec. 27, 2022

(54) TONER SUPPLY DEVICE HAVING CYLINDRICAL ROTATING CONTAINER AND PADDLE AND IMAGE FORMING APPARATUS

(71) Applicant: KYOCERA Document Solutions Inc., Osaka (JP)

(72) Inventor: Ryo Taniguchi, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 17/534,551

(22) Filed: Nov. 24, 2021

(65) Prior Publication Data

US 2022/0163915 A1 May 26, 2022

(30) Foreign Application Priority Data

Nov. 24, 2020 (JP) ..... JP2020-194491

(51) Int. Cl.
*G03G 15/08* (2006.01)
*G03G 15/00* (2006.01)

(52) U.S. Cl.
CPC ..... *G03G 15/0872* (2013.01); *G03G 15/086* (2013.01); *G03G 15/087* (2013.01); *G03G 15/556* (2013.01); *G03G 2215/0665* (2013.01)

(58) Field of Classification Search
CPC ..... G03G 15/086; G03G 15/087; G03G 15/0872; G03G 2215/0665; G03G 2215/0668; G03G 2215/0685
USPC ..... 399/262, 263
See application file for complete search history.

(56) References Cited

U.S. PATENT DOCUMENTS 5,787,320 A * 7/1998 Eun ..... G03G 15/0849 399/27
2007/0003296 A1* 1/2007 Miyata ..... G03G 15/0856 399/27
2009/0269088 A1* 10/2009 Mizuta ..... G03G 15/0872 399/30
2018/0348664 A1* 12/2018 Okamura ..... G03G 15/0856
2020/0033752 A1* 1/2020 Kubo ..... G03G 15/0856
2020/0292963 A1* 9/2020 Adachi ..... G03G 15/0886

FOREIGN PATENT DOCUMENTS

JP 2004286793 A * 10/2004
JP 2017-187671 10/2017
KR 102264525 B1 * 6/2021

* cited by examiner

*Primary Examiner* — Robert B Beatty
(74) *Attorney, Agent, or Firm* — Lex IP Meister, PLLC

(57) ABSTRACT

A toner supply device for supplying toner to a developing device includes a toner container containing toner to be supplied to the developing device and a remaining amount sensor for detecting the remaining amount of toner in the toner container. The toner container includes a cylindrical rotating container having a spiral conveying rib formed on the inner peripheral surface thereof and a paddle provided so as to be slidable on the inner peripheral surface of the rotating container. The remaining amount sensor detects the remaining amount of toner on the upstream side on or before the contact position of the paddle in the toner conveying direction.

4 Claims, 6 Drawing Sheets

TONER SUPPLY DEVICE HAVING CYLINDRICAL ROTATING CONTAINER AND PADDLE AND IMAGE FORMING APPARATUS

INCORPORATION BY REFERENCE

This application is based upon and claims the benefit of priority from the corresponding Japanese Patent Application No. 2020-194491 filed on Nov. 24, 2020, the entire contents of which are incorporated herein by reference.

BACKGROUND

The present disclosure relates to a toner supply device and an image forming apparatus.

There are two types of toner supply devices for an image forming apparatus, one is a system in which the amount of toner remaining in a developing device is predicted by a sensor and the amount of toner supplied from a toner container to the developing device is determined, and the other is a system in which the developing device does not have a sensor and toner is always supplied from the toner container to the developing device. In the latter type of toner supply device, a toner container having a spiral conveying rib formed on its inner peripheral surface may be used. In order to detect the amount of toner remaining in the toner container, a remaining amount sensor such as a magnetic permeability sensor is provided on the image forming apparatus side on which the toner container is mounted.

SUMMARY

A toner supply device for supplying toner to a developing device according to the present disclosure includes a toner container containing toner to be supplied to the developing device and a remaining amount sensor for detecting a remaining amount of toner in the toner container.

The toner container includes a cylindrical rotating container having a spiral conveying rib formed on an inner peripheral surface thereof and a paddle provided so as to be slidable on the inner peripheral surface of the rotating container.

The remaining amount sensor detects the remaining amount of toner on the upstream side on or before the contact position of the paddle in the toner conveying direction.

DETAILED DESCRIPTION

Figure 1:
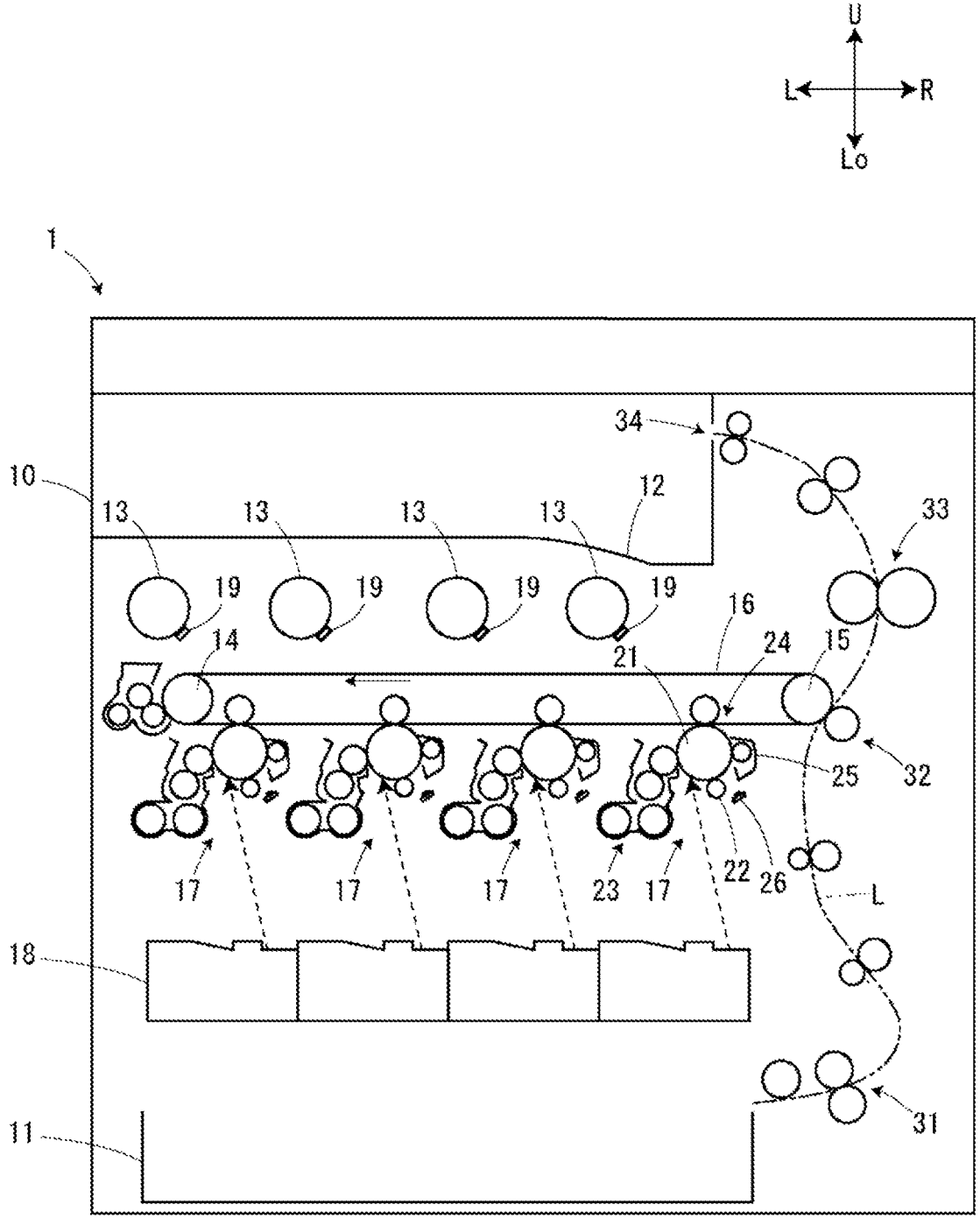
FIG. 1 is a schematic diagram of a printer according to an embodiment of the present disclosure.

Hereinafter, an image forming apparatus to which a display apparatus according to an embodiment of the present disclosure is applied will be described with reference to the drawings. In the following description, a printer is exemplified as an image forming apparatus. FIG. 1 is a schematic diagram of a printer according to an embodiment of the present disclosure. Arrows Fr, Re, U, Lo, L, and R shown in the drawings indicate front side, rear side, upper side, lower side, left side, and right side of the printer, respectively.

As illustrated in FIG. 1, the printer 1 includes a box-shaped housing 10 in which various devices are accommodated. A sheet feed cassette 11 in which a sheet bundle is set is accommodated in a lower portion of the housing 10, and a sheet discharge tray 12 on which sheets on which images have been formed are stacked is provided in an upper portion of the housing 10. Toner containers 13 containing toner are detachably set below the sheet discharge tray 12 for each color of toner (for example, four colors of magenta, cyan, yellow, and black). An intermediate transfer belt 16 stretched over a pair of left and right rollers 14 and 15 is provided below the plurality of toner containers 13.

Along the lower side of the intermediate transfer belt 16, the image forming units 17 are provided in right and left lines for each color of toner. In each image forming unit 17, a photoconductor drum 21 that is in rolling contact with the intermediate transfer belt 16 is rotatably provided, and around the photoconductor drum 21, a charging device 22, a developing device 23, a primary transfer unit 24, a cleaning device 25, and a discharging device 26 are arranged in an order of a primary transfer process. A waste toner box (not shown) is connected to the cleaning device 25. Toner is supplied from the toner container 13 to each developing device 23 through a supply path (not shown), and waste toner is discharged from each cleaning device 25 to the waste toner box through a discharge path (not shown).

An exposure device 18 constituted by a laser scanning unit (LSU) is provided below each of the image forming units 17. A sheet conveyance path L extending from the sheet feed cassette 11 toward the sheet discharge tray 12 is formed by a plurality of rollers in a right side portion in the housing 10. A sheet feeding unit 31 is provided on an upstream side (lower side) of the conveyance path L, and a secondary transfer unit 32 is provided on a right end side of the intermediate transfer belt 16 on a downstream side of the sheet feeding unit 31 in the conveyance path L. A fixing device 33 is provided on a downstream side (upper side) of the secondary transfer unit 32 in the conveyance path L, and a sheet discharge port 34 is provided on a downstream end side (upper side) of the conveyance path L.

When the printer 1 forms an image, the charging device 22 charges the surface of the photoconductor drum 21, and the exposure device 18 emits laser light to form an electrostatic latent image on the surface of the photoconductor drum 21. Toner is applied from the developing device 23 to the electrostatic latent image on the surface of the photoconductor drum 21 to form a toner image, and the toner image is primarily transferred from the surface of the photoconductor drum 21 to the surface of the intermediate transfer belt 16. The image forming units 17 primarily transfer toner images of respective colors to the intermediate transfer belt 16, thereby to form a full-color toner image on the surface of the intermediate transfer belt 16. The cleaning device 25 and the discharging device 26 remove waste toner and electric charge remaining on the photoconductor drum 21.

On the other hand, the sheet feeding unit 31 takes in a sheet from the sheet feed cassette 11 or a manual feed tray (not shown), and conveys the sheet toward the secondary transfer unit 32 in synchronization with the above-described image forming operation. In the secondary transfer unit 32, a full-color toner image is secondarily transferred from the surface of the intermediate transfer belt 16 to the surface of the sheet, and the transferred sheet is conveyed toward a fixing device 33 downstream of the secondary transfer unit 32. In the fixing device 33, the toner image is fixed on the sheet, and the fixed sheet is discharged from a sheet discharge port 34 onto the sheet discharge tray 12. In this manner, the toner image transferred on the sheet passes through the fixing device 33, and thereby an image is formed on the surface of the sheet.

In the printer 1 according to the embodiment of the present disclosure, a toner container 13 in which a spiral conveying rib is formed is mounted instead of a screw transport type toner container (not illustrated). In the screw transport type toner container, a screw and a stirring paddle are rotatably installed inside a fixed container, and toner is transported while being stirred by the rotation of the screw and the stirring paddle. On the other hand, in the toner container 13 according to the embodiment of the present disclosure, a conveying rib is formed on an inner peripheral surface of a rotating container, and toner is transported while being stirred by the rotation of the rotating container.

Incidentally, the printer 1 is provided with a remaining amount sensor 19 for detecting the remaining amount of toner in the toner container 13. When the external environment such as the temperature or the moisture of the installation place of the printer 1 changes, the fluidity of the toner in the toner container 13 changes, and the detection accuracy of the remaining amount sensor 19 may deteriorate. If the stirring paddle capable of contacting the entire inner peripheral surface of the fixed container is rotatably provided just as in the screw transport type toner container, the tip of the paddle slidingly contacts the inner peripheral surface of the fixed container, excess toner is scraped off, external force is applied to the remaining toner, and the remaining amount of toner can be detected in a state in which a change in the fluidity of the toner is suppressed.

Therefore, the toner container 13 according to the embodiment of the present disclosure is provided with a paddle for suppressing the change in the fluidity of the toner, and the remaining amount of toner in the toner container 13 is detected by the remaining amount sensor 19 near the contact position of the paddle. As a result, the remaining amount of toner in the toner container 13 is detected by the remaining amount sensor 19 in a state where the change in the fluidity of the toner is suppressed. Therefore, regardless of the change in the external environment, the remaining amount of toner in the toner container 13 can be accurately detected by the remaining amount sensor 19, and the user can be notified of the remaining amount of toner, thereby urging the user to perform such operations as replacing the toner container 13.

Figure 2:
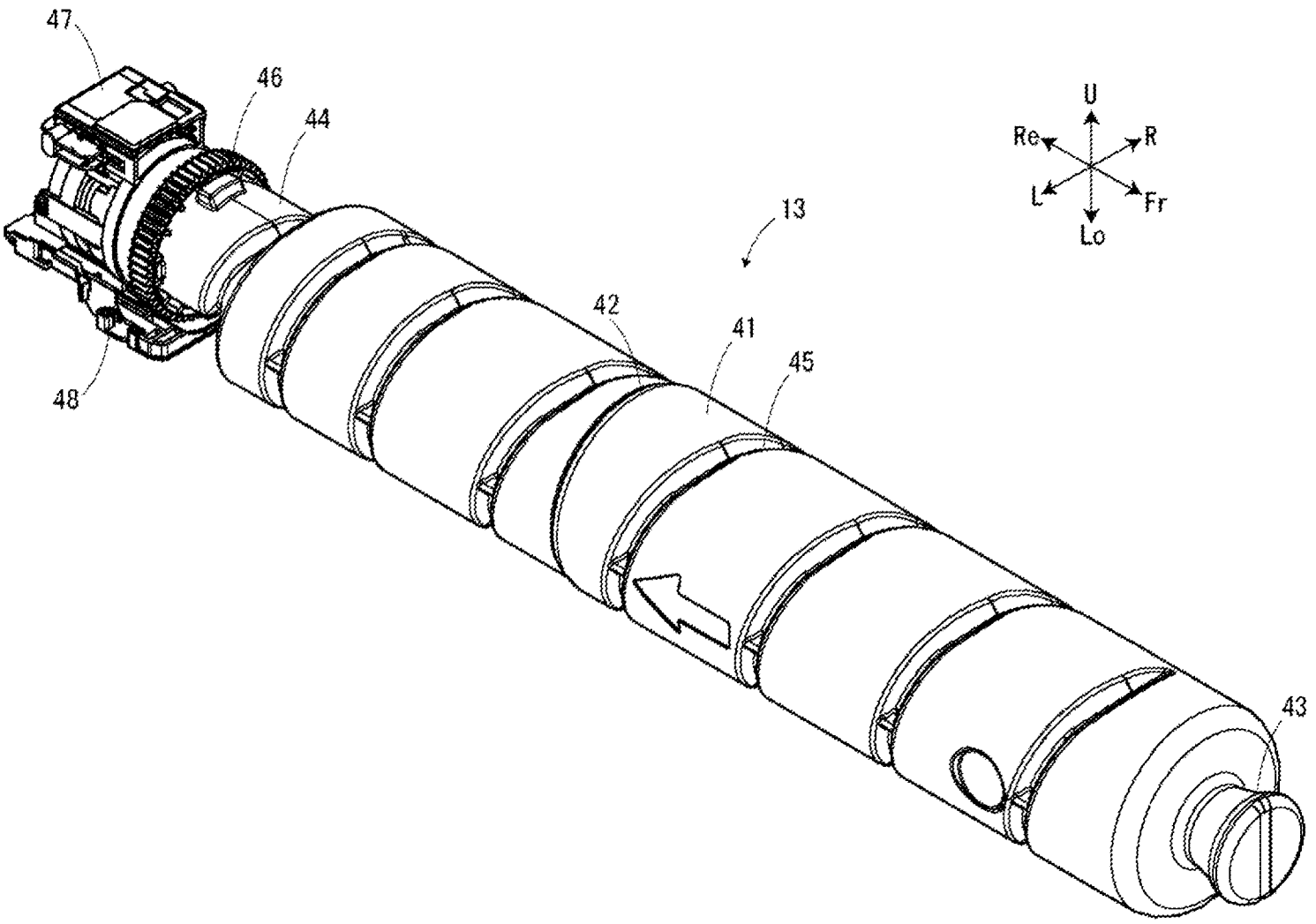
FIG. 2 is a perspective view of a toner container according to an embodiment of the present disclosure.
Figure 3:
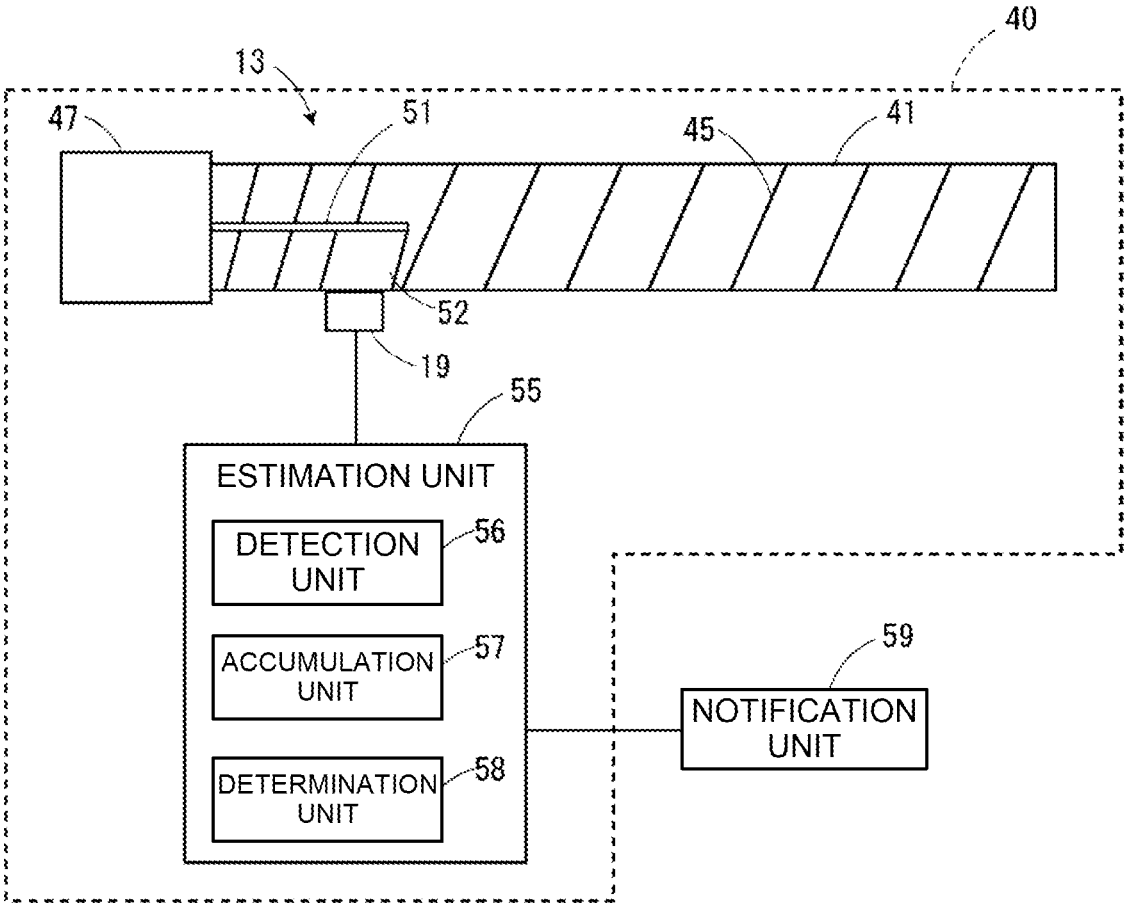
FIG. 3 is a schematic cross-sectional view of a toner supply device according to an embodiment of the present disclosure.

A toner supply device will be described with reference to FIGS. 2 and 3. FIG. 2 is a perspective view of a toner container according to an embodiment of the present disclosure. FIG. 3 is a schematic cross-sectional view of a toner supply device according to an embodiment of the present disclosure. Although a black toner container is illustrated here, magenta, cyan, and yellow toner containers have similar configurations.

As shown in FIG. 2, the rotating container 41 of the toner container 13 is formed in a cylindrical shape elongated in the front-rear direction. An outer peripheral surface of the rotating container 41 is formed such that a substantially half portion on the other end side (rear side) is lower by one step than a substantially half portion on one end side (front side), with a step 42 at a center position in the rotation axis direction as a boundary. A shaft portion 43 having an inverted truncated cone shape in a cross-sectional view protrudes from one end surface of the rotating container 41 toward one side in the rotation axis direction, and a cylindrical neck portion 44 protrudes from the other end surface of the rotating container 41 toward the other side in the rotation axis direction. An outer peripheral surface of the rotating container 41 is recessed in a groove shape, and a spiral conveying rib 45 is formed from an inner peripheral surface of the rotating container 41 to an inner peripheral surface of the neck portion 44.

A transmission gear 46 is mounted on an outer peripheral surface of the neck portion 44 of the toner container 13, and a drive source (not shown) is connected to the transmission gear 46 via a power transmission mechanism. One end side of the neck portion 44 is open, and this opening is covered by a case lid 47 via a seal member (not shown). At this time, the transmission gear 46 is coupled to the neck portion 44 so as to be integrally rotatable, and the case lid 47 is in contact with the neck portion 44 so as to be idly rotatable. A toner supply port directed toward the developing device 23 is formed in a lower surface of the case lid 47, and a shutter member 48 for opening and closing the supply port is provided in a lower portion of the case lid 47.

As shown in FIG. 3, a support shaft 51 protruding into the rotating container 41 is fixed to the case lid 47. The support shaft 51 extends to one end from the case lid 47 on the rotational axis of the toner container 13, and a paddle 52 for sliding toner against the inner peripheral surface of the rotating container 41 is fixed to the tip of the support shaft 51. The paddle 52 is formed of a flexible resin film and extends from the support shaft 51 toward the inner peripheral surface of the rotating container 41. The conveying rib 45 protrudes from the inner peripheral surface of the rotating container 41, but the tip of the paddle 52 is bent and contacts the inner peripheral surface of the rotating container 41 while riding across the conveying rib 45.

In addition to the toner container 13, the toner supply device 40 is provided with a remaining amount sensor 19 for detecting the remaining amount of toner in the toner container 13 and an estimation unit 55 for estimating the empty state based on the detection result of the remaining amount sensor 19. As the remaining amount sensor 19, a magnetic permeability sensor for detecting the bulk density of toner in the toner container 13, that is, the magnetic permeability corresponding to the remaining amount of toner is used. The remaining amount sensor 19 detects the magnetic permeability, and a voltage value corresponding to the detection result is output from the remaining amount sensor 19 to the estimation unit 55. The remaining amount sensor 19 detects the remaining amount of toner near the position of the toner in contact with the paddle 52.

Figure 5:
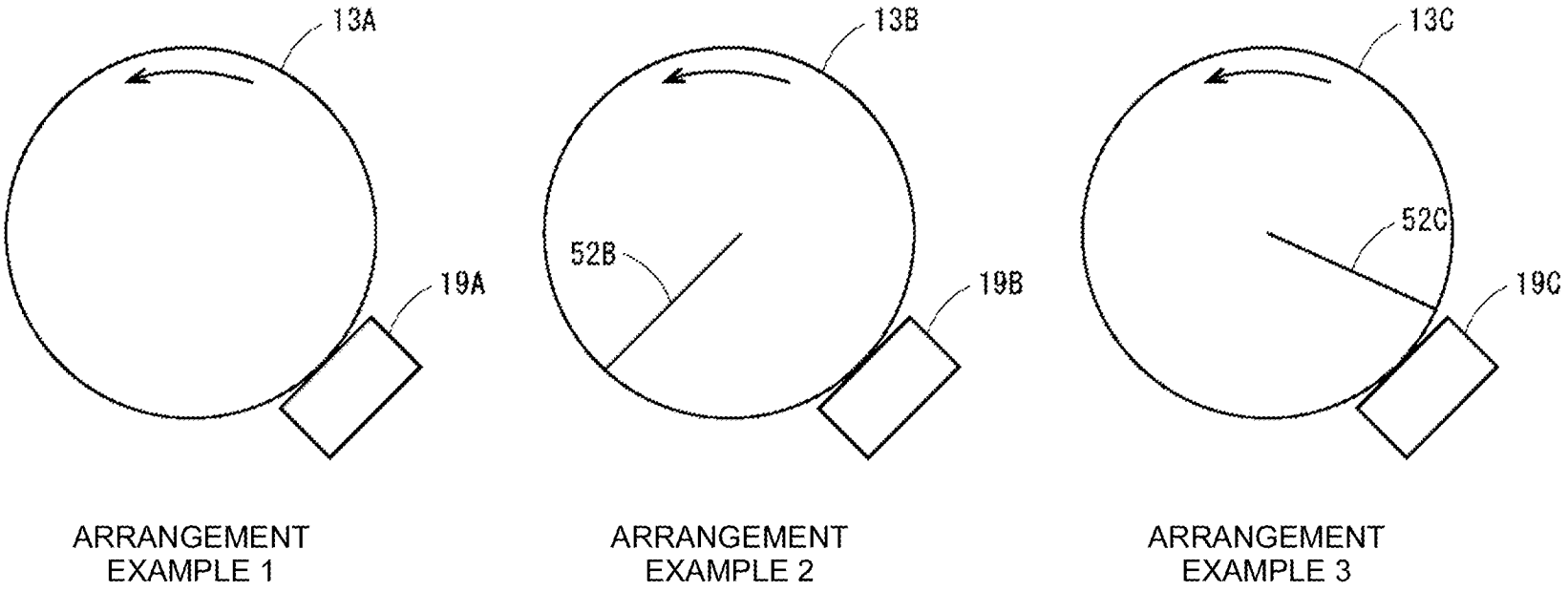
FIG. 5 is a diagram illustrating a positional relationship between the paddle and the remaining amount sensor in the rotation direction.

More specifically, the remaining amount sensor 19 detects the remaining amount of toner at a position that is the same as the contact position of the paddle 52 in the rotation axis direction of the rotating container 41 and that is adjacent to the upstream side of the contact position of the paddle 52 in the rotation direction of the rotating container 41 (see arrangement example 3 in FIG. 5). In the vicinity of the detection position of the remaining amount sensor 19, excess toner is scraped off by the paddle 52 and an external force is applied to the toner, thereby suppressing changes in the fluidity of the toner caused by external environments such as temperature and humidity. As a result, the variation in the detection result of the remaining amount sensor 19 is reduced, so that the remaining amount of toner in the toner container 13 can be accurately detected.

The estimation unit 55 is provided with a detection unit 56 that detects a low state from the detection result of the remaining amount sensor 19, an accumulation unit 57 that accumulates the toner consumption amount after the low state is detected, and a determination unit 58 that determines an empty state from the cumulative value of the toner consumption amount. The low state is a state in which the toner remaining amount in the toner container 13 is smaller than a specified amount but is larger than the empty state. The empty state is a state in which no toner remains in the toner container 13. In the embodiment of the present disclosure, the printable number of sheets from the low state is set to 500 sheets and the printable number of sheets from the empty state is set to 0 sheets at a printing rate of 5%.

A detection threshold corresponding to the low state is set in the detection unit 56. When a voltage value less than the detection threshold is output from the remaining amount sensor 19, the low state of the toner amount in the toner container 13 is detected. The accumulation unit 57 calculates the toner consumption amount from the printing rate and the number of printed sheets, and accumulates the toner consumption amount after the detection of the low state. A determination threshold corresponding to the empty state is set in the determination unit 58. When the cumulative value of the toner consumption amount is larger than the determination threshold, the toner remaining amount is determined to be in the empty state, and when the cumulative value of the toner consumption amount is equal to or smaller than the determination threshold, the toner remaining amount is determined to be in the low state.

In such a toner supply device 40, the driving force of the driving source is transmitted to the transmission gear 46, and the rotating container 41 is integrally rotated together with the transmission gear 46. As the rotating container 41 rotates, the toner is conveyed from one end side toward the supply port on the other end side while being stirred along the spiral conveying rib 45. At this time, the rotating container 41 is rotated in a state where the paddles 52 are stopped, and the remaining amount of toner is detected by the remaining amount sensor 19 in a state where the flow of toner is suppressed by the paddles 52. Then, the estimation unit 55 estimates whether the state is the empty state or the low state, and the notification unit 59 such as a display provided in the printer 1 notifies the user of the estimation result.

Each unit of the estimation unit 55 may be implemented by software using a processor, or may be implemented by a logic circuit (hardware) formed in an integrated circuit or the like. When a processor is used, the processor reads and executes a program stored in a memory to perform various types of processing. As the processor, for example, a central processing unit (CPU) is used. The memory is configured by one or a plurality of storage media such as a read only memory (ROM) and a random access memory (RAM) according to use.

Figure 4:
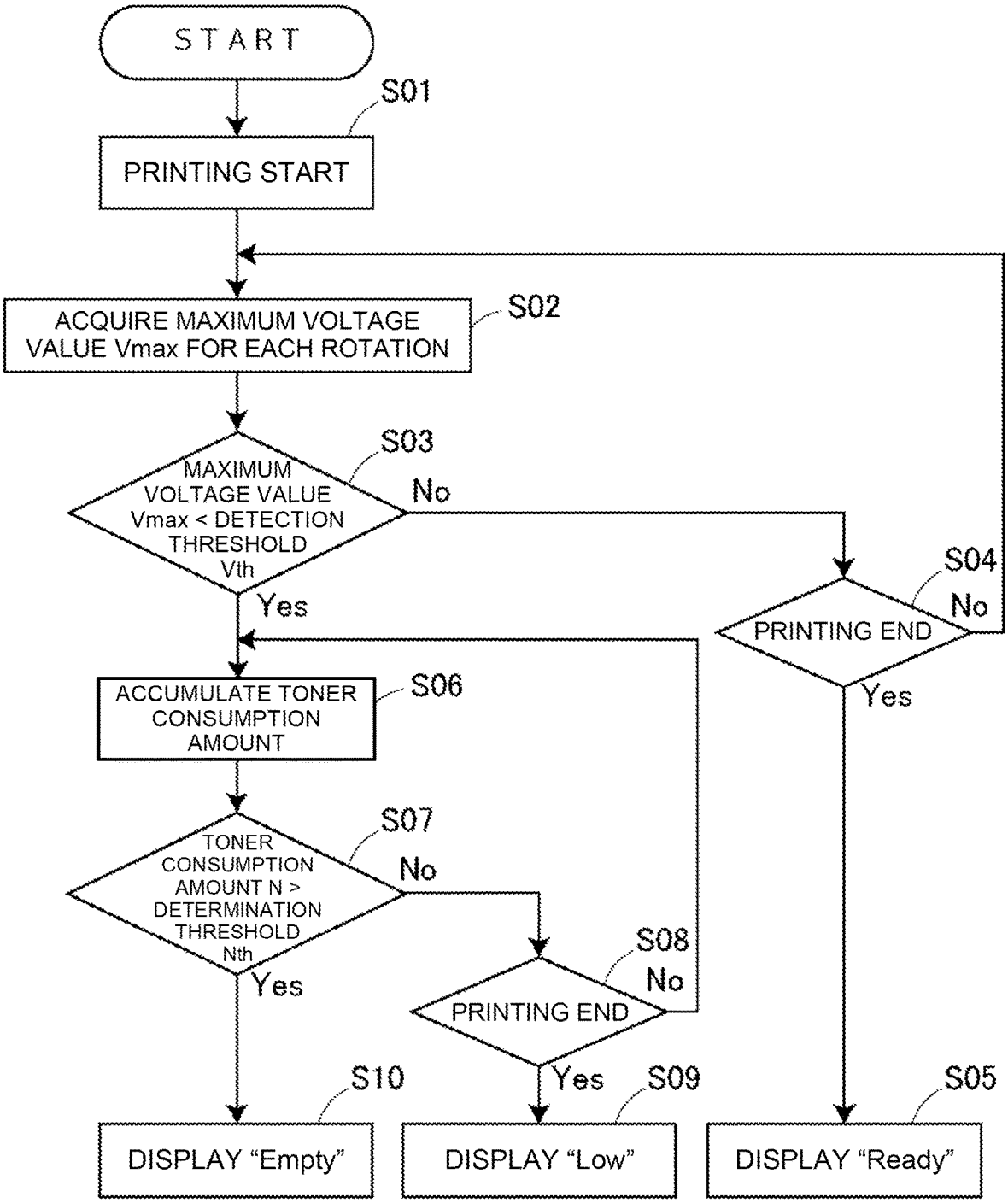
FIG. 4 is a flowchart illustrating an empty state estimation process according to an embodiment of the present disclosure.

The empty state estimation process of the toner container will be described with reference to FIG. 4. FIG. 4 is a flowchart illustrating the empty state estimation process according to an embodiment of the present disclosure. In FIG. 4, the reference numerals of FIG. 3 are used as appropriate for description.

As illustrated in FIG. 4, when printing is started (step S01), a voltage value is output from the remaining amount sensor 19 to the detection unit 56, and the detection unit 56 acquires a maximum voltage value Vmax for each rotation of the rotating container 41 (step S02). Next, the detection unit 56 determines whether the maximum voltage value Vmax is less than a detection threshold Vth (step S03). If the maximum voltage value Vmax is greater than or equal to the detection threshold Vth (No in step S03), the processes of steps S02 and S03 are repeated until printing ends (No in step S04). When printing ends (Yes in step S04), Ready is displayed on the display of the printer 1 (step S05).

On the other hand, in a case where the maximum voltage value Vmax is less than the detection threshold Vth (Yes in step S03), the accumulation unit 57 accumulates the toner consumption amount obtained from the printing rate and the number of printed sheets (step S06). Next, it is determined whether the cumulative value N of the toner consumption amount is greater than the determination threshold Nth (step S07). In a case where the cumulative value N of the toner consumption amount is equal to or less than the determination threshold Nth (No in step S07), the processes of steps S06 and S07 are repeated until printing ends (No in step S08). When printing ends (Yes in step S08), Low is displayed on the display of the printer 1 (step S09).

Then, when the cumulative value N of the toner consumption amount is larger than the determination threshold Nth (Yes in step S07), printing is stopped and "Empty" is displayed on the display of the printer 1 (step S10). As described above, at the end of printing, Ready is displayed on the display when there is a remaining toner amount in the toner container 13, "Low" is displayed on the display when the remaining toner amount in the toner container 13 decreases, and "Empty" is displayed on the display when the remaining toner amount in the toner container 13 reaches 0. It is possible to make the user recognize whether the toner container 13 is in the empty state or in the low state.

Figure 6:
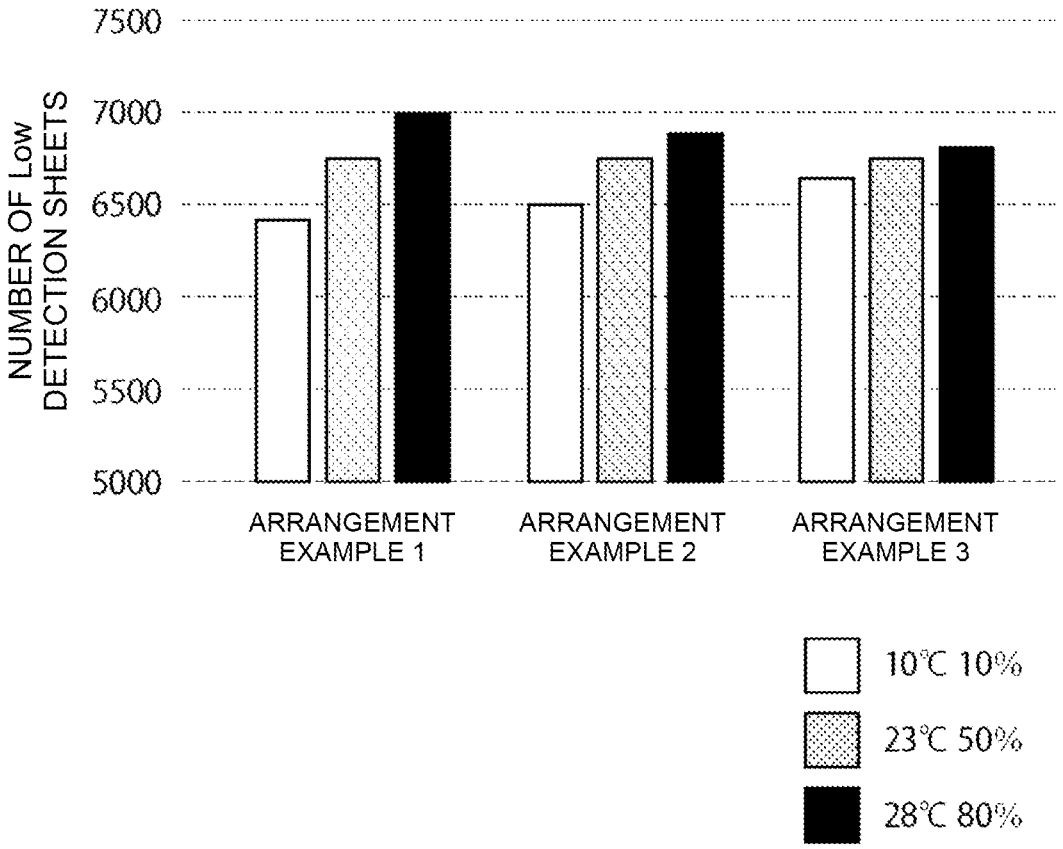
FIG. 6 is a graph showing the number of Low detection sheets of the remaining amount sensor.

Referring to FIGS. 5 and 6, the detection accuracy of the remaining amount sensor will be described. FIG. 5 is a diagram showing the positional relationship between the paddle and the remaining amount sensor in the rotation direction. FIG. 6 is a graph showing the number of Low detection sheets of the remaining amount sensor. In FIG. 5, the remaining amount sensor and the paddle are positioned at the same position in the rotation axis direction.

As shown in FIG. 5 and FIG. 6, the toner remaining amounts when the temperature and humidity conditions were changed were compared in the arrangement examples 1-3 in which the positional relationship between the paddles and the remaining amount sensor is different from each other. The toner container 13A of the arrangement example 1 is not provided with a paddle, and the remaining amount sensor 19A is arranged independently of the paddle. In the toner container 13B of the arrangement example 2, the remaining amount sensor 19B is arranged at a position away from the contact position of the paddle 52B in the rotation direction to the downstream side. In the toner container 13C of the arrangement example 3, the remaining amount sensor 19C is arranged at a position adjacent to the upstream side of the contact position of the paddle 52C in the rotation direction.

As temperature and humidity conditions, three temperature and humidity environments were reproduced: a low temperature and low humidity environment with a temperature of 10° C. and a humidity of 10%, a normal environment with a temperature of 23° C. and a humidity of 50%, and a high temperature and high humidity environment with a temperature of 28° C. and a humidity of 80%. In the normal environment, the detection threshold of the detection unit 56 (see FIG. 4) was set so that the low state of the toner is detected 500 sheets before the maximum number of printed sheets of 7200 sheets at which the toner is in the empty state at a printing rate of 5%, for example at 6800 sheets, and the temperature and humidity conditions were changed for the toner containers 13A-13C of the arrangement example 1-3 and the number of printing sheets from the start of printing to the detection of the low state was evaluated.

As a result, in the toner container 13A of the arrangement example 1, the low state was detected at about 6400 sheets in the low-temperature and low-humidity environment, and the low state was detected at about 7000 sheets in the high-temperature and high-humidity environment, which indicates that the detection of the low state is accelerated because toner is easily separated from the inner peripheral surface of the toner container 13A in the low-temperature and low-humidity environment and that the detection of the low state is delayed because toner easily remains on the inner peripheral surface of the toner container 13A in the high-temperature and high-humidity environment. As described above, in the toner container 13A, the fluidity of toner greatly changes due to changes in temperature and humidity conditions, and the detection accuracy of the low state of the remaining amount sensor 19A is low.

On the other hand, in the toner container 13B of the arrangement example 2, the low state was detected at about 6500 sheets in the low-temperature and low-humidity environment, and the low state was detected at about 6900 sheets in the high-temperature and high-humidity environment because the paddle 52B fills the inner peripheral surface of the toner container 13B with toner in the low-temperature and low-humidity environment, and the paddle 52B scrapes off excess toner from the inner peripheral surface of the toner container 13B in the high-temperature and high-humidity environment. As described above, the change in the fluidity of the toner due to the change in temperature and humidity conditions is suppressed, the toner density in the vicinity of the detection position of the remaining amount sensor 19B is brought close to a constant value, and the detection accuracy of the low state of the remaining amount sensor 19B is improved.

Further, in the toner container 13C of the arrangement example 3, the number of sheets detected in the low state in the low-temperature and low-humidity environment and the high-temperature and high-humidity environment is made closer to each other. This is because the remaining amount sensor 19C is disposed near the contact position of the paddle 52C, and the paddle 52C accumulates the toner in the vicinity of the remaining amount sensor 19C, and the paddle 52C scrapes the excess toner in the vicinity of the remaining amount sensor 19C. In this way, the change in the fluidity of the toner due to the change in temperature and humidity conditions in the vicinity of the remaining amount sensor 19C is suppressed, the toner density in the vicinity of the detection position of the remaining amount sensor 19C is made closer to a constant value, and the detection accuracy of the low state of the remaining amount sensor 19C is improved.

As described above, according to the embodiment of the present disclosure, the toner in the toner container 13 is transported toward the developing device 23 by the rotation of the rotating container 41 along the spiral conveying rib 45. The tip of the paddle 52 is brought into sliding contact with the inner peripheral surface of the rotating container 41 while riding across the conveying rib 45, so that the change in the fluidity of the toner adhering to the inner peripheral surface of the rotating container 41 is suppressed by the paddle 52. When the toner remaining amount is detected by the remaining amount sensor 19 in a state where the change in the fluidity of the toner is suppressed, the variation in the detection result of the remaining amount sensor 19 caused by the change in the external environment is reduced. Therefore, the remaining amount of toner in the toner container 13 can be accurately detected by the remaining amount sensor 19 regardless of the change in the external environment.

In addition, since the toner supply device 40 according to the embodiment of the present disclosure is installed in the printer 1, it is possible to notify the user of the remaining amount of toner and to urge the user to perform replacement work or preparation of the toner container 13.

Figure 7:
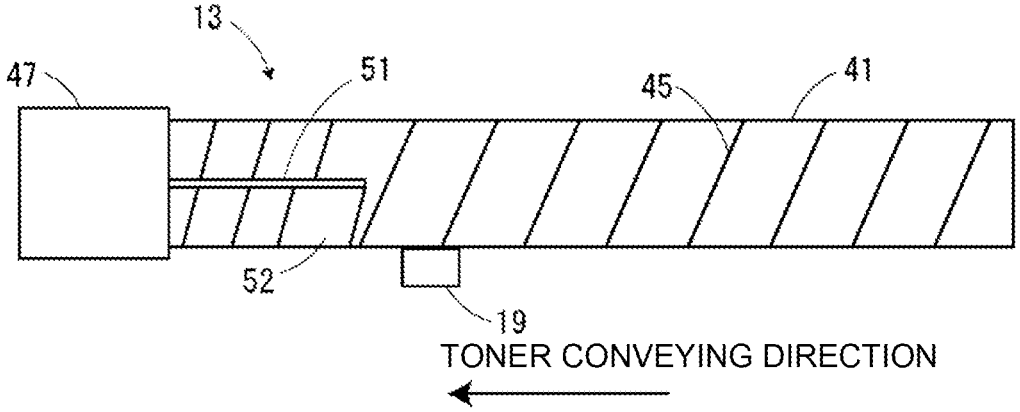
FIG. 7 is a schematic view of a toner container according to a modification.

In the embodiment of the present disclosure, the remaining amount sensor detects the remaining amount of toner at the same position as the contact position of the paddle in the direction of the rotation axis of the rotating container. However, as shown in FIG. 7, the remaining amount sensor 19 may detect the remaining amount of toner on the upstream side on or before the contact position of the paddle 52 in the direction of the toner conveyance along the direction of the rotation axis.

In addition, in the embodiment of the present disclosure, the display is exemplified as the notification unit, but the notification unit may be a lamp or a speaker capable of notifying the empty state and the low state, that is, the empty state and the low state may be light-emitted by the lamp or the empty state and the low state may be audibly notified by the speaker.

In addition, in the embodiment of the present disclosure, the magnetic permeability sensor is exemplified as the remaining amount sensor. However, the remaining amount sensor may be, for example, a pressure sensor as long as it is capable of detecting the remaining amount of toner.

In addition, in the embodiment of the present disclosure, the toner supply device identifies the empty state and the low state of the toner, but the toner supply device may detect at least the low state of the toner.

In addition, in the embodiment of the present disclosure, the sheet may be a sheet-like object on which an image is to be formed, and may be, for example, plain paper, coated paper, tracing paper, or an overhead projector (OHP) sheet.

Although the embodiments of the present disclosure have been described, the above-described embodiments and modifications may be combined in whole or in part as other embodiments.

Further, the technology of the present disclosure is not limited to the above-described embodiments, and may be changed, substituted, or modified in various ways without departing from the spirit of the technical idea. Furthermore, the invention may be implemented using a method in which the technical idea can be realized in a different manner by means of a technical advance or another derived technique. Therefore, the claims cover all embodiments that may be included within the scope of the technical idea.

What is claimed is:

1. A toner supply device for supplying toner to a developing device, comprising:

a toner container containing toner to be supplied to the developing device; and a remaining amount sensor detecting a remaining amount of toner in the toner container, wherein the toner container comprises a cylindrical rotating container having a spiral conveying rib formed on an inner peripheral surface thereof, and a paddle provided so as to slidably contact the inner peripheral surface of the rotating container, and wherein the remaining amount sensor is provided at a position that is the same as a contact position of the paddle in a rotation axis direction of the rotating container and is adjacent to the contact position on an upstream side of the paddle in a rotation direction of the rotating container.

2. The toner supply device according to claim 1, wherein the remaining amount sensor detects the remaining amount of toner at the position that is the same as the contact position of the paddle in the rotation axis direction of the rotating container and that is adjacent to the contact position on the upstream side of the paddle in the rotation direction of the rotating container.

3. The toner supply device according to claim 1, further comprising an estimation unit estimating an empty state from a detection result of the remaining amount sensor, wherein the estimation unit comprises a detection unit detecting a low state from the detection result of the remaining amount sensor, an accumulation unit accumulating a toner consumption amount after the low state is detected, and a determination unit determining an empty state from a cumulative value of the toner consumption amount, and the determination unit determines an empty state when the cumulative value of the toner consumption amount is larger than a determination threshold and determines a low state when the cumulative value of the toner consumption amount is equal to or smaller than the determination threshold.

4. An image forming apparatus comprising:

the toner supply device according to claim 1; and a notification unit notifying the remaining amount of toner detected by the toner supply device.

* * * * *